United States Patent [19]

Bergey et al.

[11] 3,974,637

[45] Aug. 17, 1976

[54] LIGHT EMITTING DIODE WRISTWATCH WITH ANGULAR DISPLAY

[75] Inventors: John M. Bergey; Robert E. McCullough; Arthur H. O'Connor, all of Lancaster, Pa.

[73] Assignee: Time Computer, Inc., Lancaster, Pa.

[22] Filed: Mar. 28, 1975

[21] Appl. No.: 563,105

[52] U.S. Cl. ..... 58/50 R; 58/23 R

[51] Int. Cl.[2] ..... G04C 3/00

[58] Field of Search ..... D10/30, 31, 32, 38; 58/23 R, 50 R, 88 R

[56] References Cited

UNITED STATES PATENTS

| | | | |
|---|---|---|---|
| 3,566,602 | 3/1971 | Bergey et al. | 58/50 R |
| 3,576,099 | 4/1971 | Walton | 58/50 R |
| 3,757,511 | 9/1973 | Burgess et al. | 58/50 R |
| 3,768,247 | 10/1973 | Fujita | 58/50 R X |
| 3,800,525 | 4/1974 | Bergey | 58/50 R |
| 3,823,551 | 7/1974 | Riehl | 58/23 R |
| 3,849,979 | 11/1974 | Tanji | 58/50 R |
| D225,429 | 12/1972 | Vuilleumier | D10/38 |
| D229,213 | 11/1973 | Sasaki | D10/38 |

*Primary Examiner*—Ulysses Weldon
*Attorney, Agent, or Firm*—LeBlanc & Shur

[57] ABSTRACT

Disclosed is a solid state wristwatch having an active electro-optical display in the form of light emitting diodes. The display is mounted on one sloping side of a groove in a circular module frame and comprises a ceramic substrate having the display on one side and a large scale integrated circuit on the other. The angular orientation of the display coincides with the axis of an angularly oriented viewing window constructed so that the watch case shades at least part of the display. Viewing under bright daylight is enhanced and through ambient light responsive control of current to the display, battery energy under most viewing conditions is conserved.

14 Claims, 14 Drawing Figures

FIG. 1
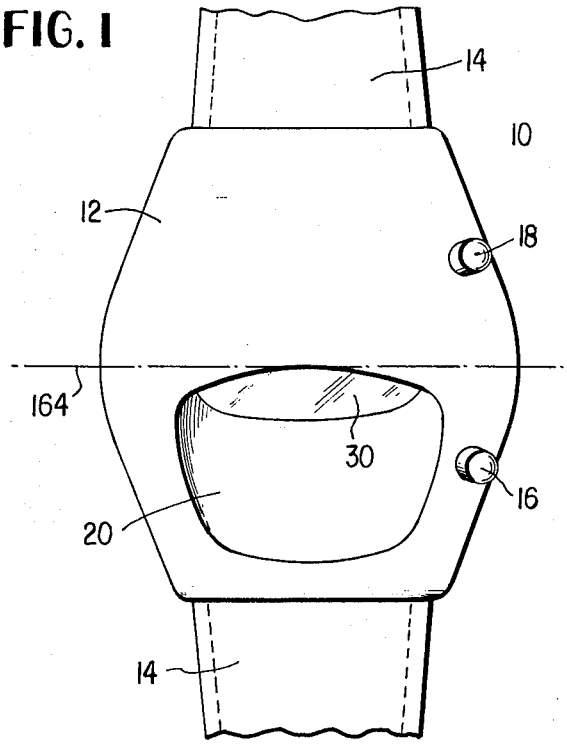
FIG. 2
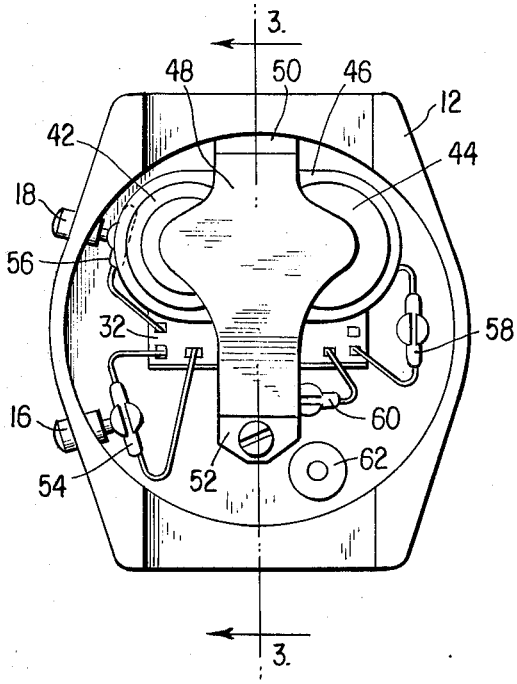
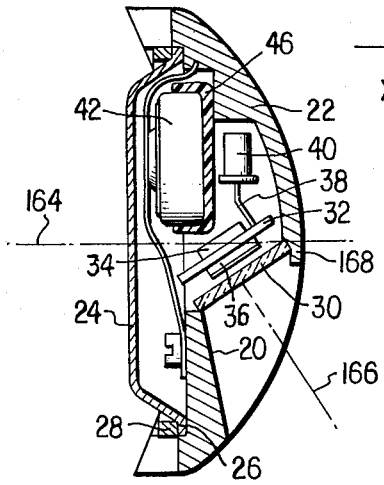
FIG. 3
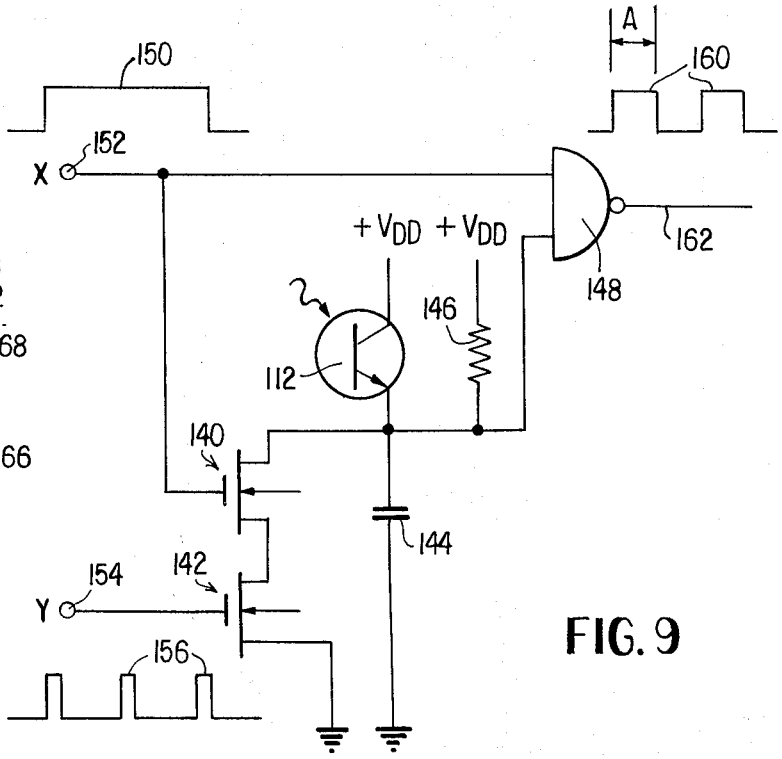
FIG. 9

LIGHT EMITTING DIODE WRISTWATCH WITH ANGULAR DISPLAY

This invention is directed to a solid state wristwatch with active electrical display elements such as light-emitting diodes and more particularly is directed to a wristwatch of this type using an angular or tilted display which is recessed in and shaded by a portion of the watch case. The angular recessed construction increases display contrast and apparent brightness so as to conserve battery energy and to make the display more readable in bright daylight.

Solid state light emitting diode wristwatches are disclosed in assignee's U.S. Pat. Nos. 3,672,155, 3,759,031 and 3,803,827, as well as others, and in assignee's copending applications Ser. Nos. 504,734 and 504,770, both filed Sept. 10, 1974, in the names of Arthur H. O'Connor and Robert E. McCullough.

Watches of this type utilize essentially no moving parts and comprise a frequency standard in the form of a crystal oscillator which acts through solid state electronic circuit dividers and drivers to power in timed sequence the light emitting diodes of an electro-optical display. Both time and calendar information may be viewed on the same display elements and the electrical circuitry of the wristwatch is formed primarily of one or more large scale integrated circuits.

It has been proposed in the past to provide wristwatches with an angularly oriented digital display and constructions of this type are shown, for example, in assignee's U.S. Pat. No. 3,566,602, 3,576,099 and 3,613,351. The angular displays were proposed to provide a more ready viewing of the digital display in relation to the eyes of the viewer when the wristwatch is in its normal position on the wrist of a wearer. However, constructions of this type in the past have not gained wide acceptance because the slanted or angular display tends to substantially add to the overall thickness of the wristwatch and more importantly in the past has made the wristwatch more difficult and expensive to manufacture and assemble. For these reasons, a vast majority of the digital display wristwatches and particularly those utilizing an electrooptical display which have been commercially successful have utilized a non-angular or flat display which is viewed directly through the top of the watch case in the same manner as most conventional wristwatches utilizing watch hands.

The present invention is based upon the discovery that by angularly orienting an active display such as one utilizing light emitting diodes and recessing the angular display so that it is partially shaded by the watch case, substantial advantages can be obtained both in readability and in reduced power consumption, thus prolonging the life of the wristwatch battery. Furthermore, in the present invention, the angular orientation of the display is made possible by a novel stepped modular construction which both minimizes overall watch thickness but, at the same time, is of simplified and inexpensive construction and, because of its circular configuration, is fully compatible with a wide variety of curved wristwatch case designs.

In the present invention a circular modular frame is provided with a central recess separating thinner and thickner portions of the frame and defining an elongated slanted side which serves as a support for an angularly oriented substrate. Mounted on the underside of the substrate is one or more large scale integrated circuits forming the principle components for the wristwatch and on the other side is the light emitting diode display, a light sensor or photosensor, and additional electrical components external to the large scale integrated circuit. The wristwatch case is of curved construction with an angular viewing window confined to approximately one-half of the case surface. Supported from the case at the inner end of the viewing window and overlying the light emitting diode display is a suitable light filter such as a bandpass optical filter for passing, for example, red light and substantially attenuating light of different wave lengths.

By recessing the display within the watch case and behind the filter, the contrast ratio of the display is increased and the amount of ambient light reflected back out through the filter is reduced. These two effects increase the apparent brightness of the display so that viewing in daylight conditions is enhanced when maximum current is supplied to the display diodes and, at the same time, less current is required during a normal inside viewing, and at other times when the display is actuated by a reduced current. In addition to improving the display under maximum current conditions (full daylight), satisfactory contrast is obtained with less current under all other viewing conditions, thereby significantly decreasing the power drain on the watch battery.

It is therefore one object of the present invention to provide an improved solid state wristwatch having active electro-optical display elements.

Another object of the present invention is to provide a light emitting diode wristwatch in which the display is more visible in bright sunlight.

Another object of the present invention is to provide a light emitting diode solid state wristwatch having reduced power consumption under most viewing conditions.

Another object of the present invention is to provide a light emitting diode wristwatch having a recessed angular digital display.

Another object of the present invention is to provide a light emitting diode wristwatch with an angular display that is relatively thin and of simplified and inexpensive construction.

Another object of the present invention is to provide an improved module frame for a light emitting diode wristwatch having an angular display orientation.

These and further objects and advantages of the invention will be more apparent upon reference to the following specifications, claims and appended drawings, wherein:

FIG. 1 is a top plan view of a wristwatch constructed in accordance with the present invention;

FIG. 2 is a rear view of the wristwatch of FIG. 1 with the case back removed;

FIG. 3 is a cross section taken along line 3—3 of FIG. 2;

FIG. 9 is a circuit diagram of the variable duty cycle control circuit for the light emitting diodes of the wristwatch of this invention.

Figure 4:
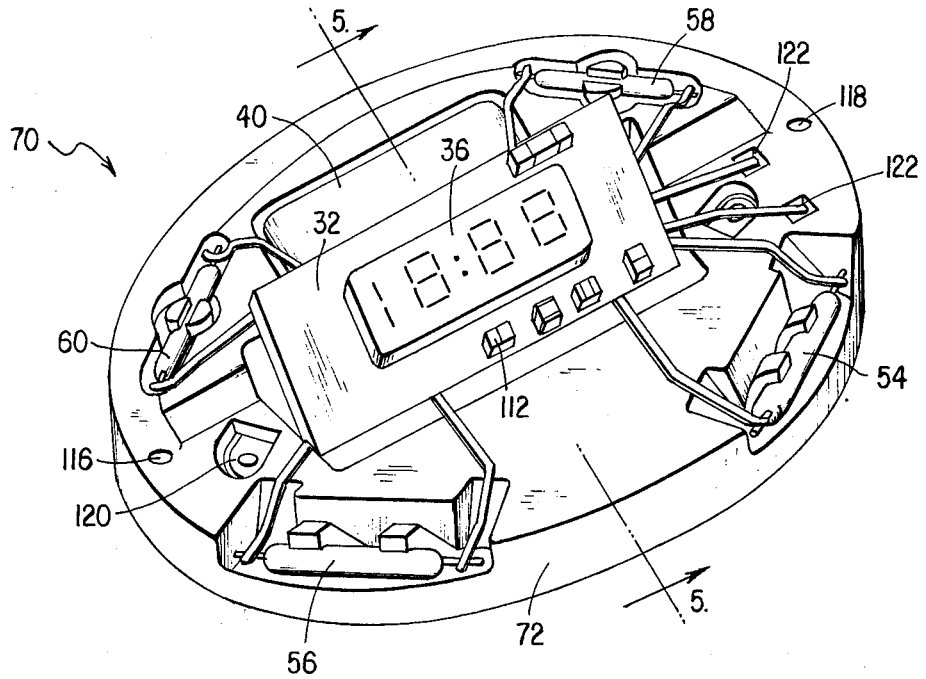
FIG. 4 is a perspective view of a novel modular construction for the movement of the watch of FIGS. 1–3.

Referring to the drawings, a first embodiment of the wristwatch of the present invention is illustrated in FIGS. 1–3. The wristwatch generally indicated at 10 in FIG. 1 comprises a watch case 12 to which is attached a wristband or bracelet 14. Mounted on the watch case are a pair of pushbuttons 16 and 18 which, when manually depressed, actuate the display to display time and calendar information respectively in a well known manner. Passing through the case is an opening 20 defining a viewing window through which the display may be read by the wearer.

Referring to FIG. 3, the case 12 comprises a bezel 22 to which is secured a case back or backplate 24. Backplate 24 is provided with an annular flange 26 secured to the bezel by a rotatable threaded ring 28 which threads into the bezel and clamps the flange 26 between the bezel and the ring.

Connected to bezel 22 by a suitable adhesive or the like applied to its edges is a band pass filter 30 for transmitting red light while strongly attenuating light having a wavelength other than red. Located inside the case beneath filter 30 is a ceramic substrate 32 on one side of which is mounted a large scale integrated circuit 34 and on the other side a plurality of light emitting diodes 36 which, when energized, give off preferably red light. If different colored light emitting diodes are utilized, then the pass band of filter 30 is modified accordingly. Connected to substrate 32 by a lead 38 is the quartz crystal 40. The quartz crystal forms part of a crystal oscillator in which the active components are incorporated in the large scale integrated circuit 34 and which oscillator forms the timekeeping base for the wristwatch.

Referring to FIGS. 2 and 3, the wristwatch is powered by a pair of batteries 42 and 44 which, by way of example only, may be conventional 1 ½ volt cells connected in series. These are removably mounted in a holder 46 and retained in place by a cell connector 48. The cell connected is secured to the bezel by a lip 50 received at one end in an appropriate slot in the bezel and is secured at its other end by a screw 52. Mounted on the bezel and electrically connected to the integrated circuit 34 by way of substrate 32 are four reed switches 54, 56, 58 and 60. These are magnetically actuated switches and the first two are actuated by the respective time demand button 16 and date demand pushbutton 18. Switches 58 and 60 are setting switches and are actuated by a permanent magnet applied to the backplate 24 adjacent the appropriate setting switch. Finally, also mounted on the bezel is a variable capacitor or trimmer 62 for the time base or oscillator of which piezoelectric quartz crystal 40 also forms a part.

A wristwatch as shown in the embodiment of FIGS. 1 through 3 has been constructed and successfully operated. In this embodiment, the various components inside the bezel were potted in a suitable insulating adhesive material such as epoxy which has been omitted from FIGS. 1 through 3 for the sake of clarity. However, this construction is time consuming and expensive to manufacture so that a preferred embodiment in which the components are of modular construction and assembled on a common modular frame is illustrated in FIG. 4. In this modified embodiment, the watch case is of exactly the same configuration as shown in FIGS. 1 through 3 except the modular construction of FIG. 4 permits the use of a smaller size case.

Figure 5:
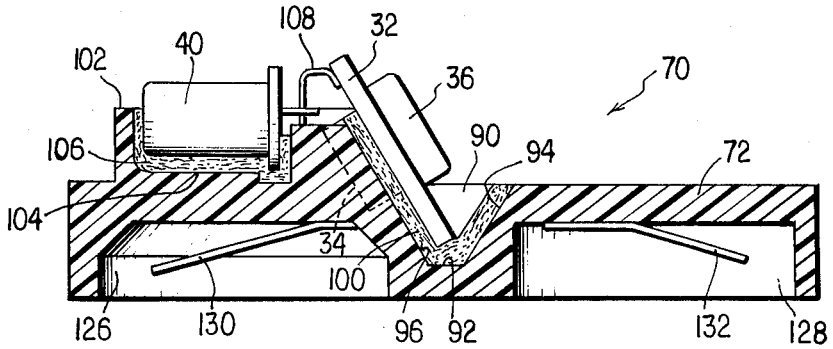
FIG. 5 is a cross section through the module assembly taken along line 5—5 of FIG. 4.
Figure 6:
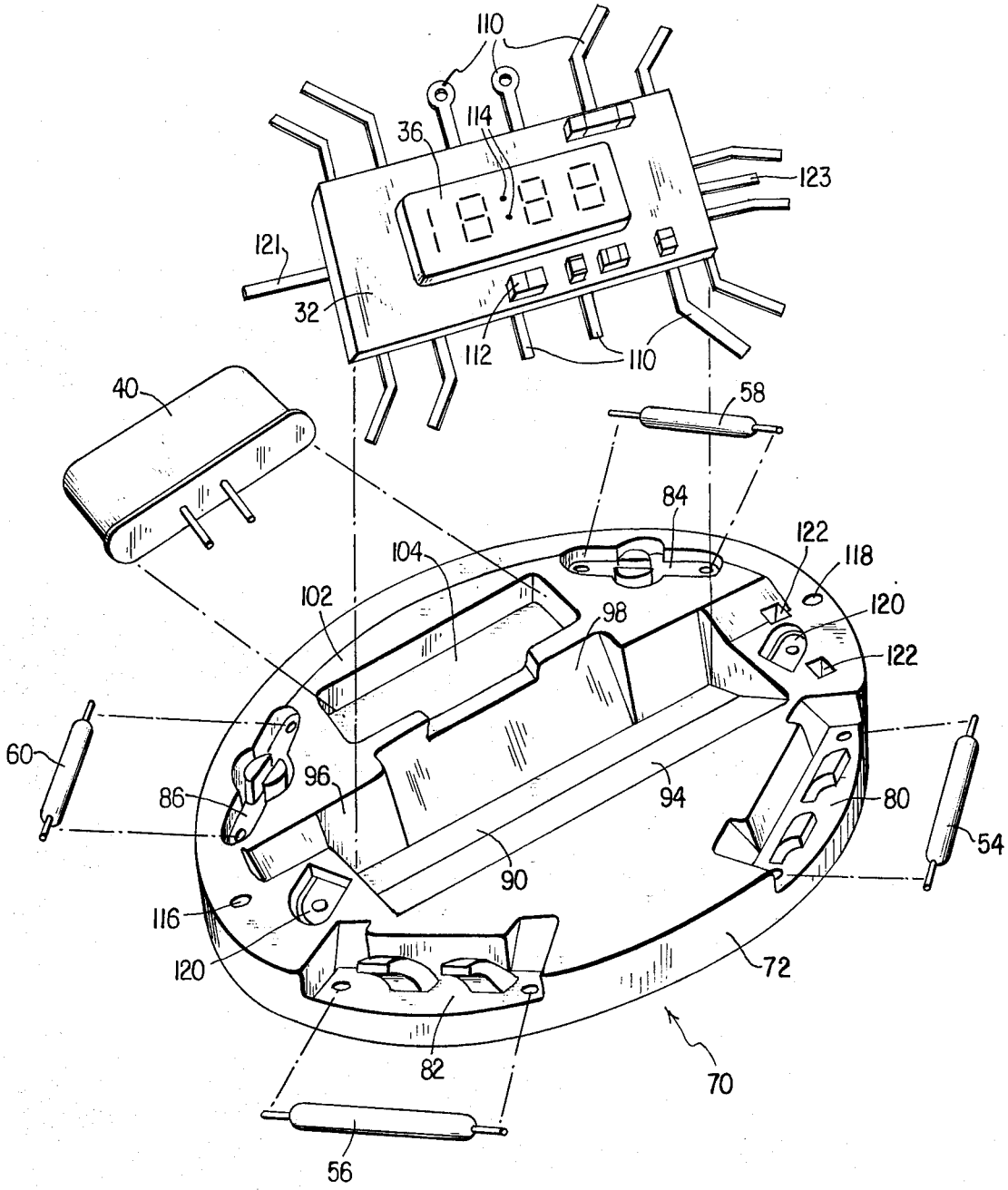
FIG. 6 is an exploded view of the module assembly of FIG. 4.

Referring to FIG. 4, in which like parts bear like reference numerals, the modular assembly indicated at 70, which corresponds roughly to a conventional watch movement, comprises a circular main frame or module frame 72, preferably formed of suitable electrically insulating plastic. FIG. 5 is a cross section through the modular assembly taken along lines 5—5 of FIG. 4 and FIG. 6 is an exploded view of the module assembly of FIG. 4.

Module frame 72 is of circular construction and includes four wells 80, 82, 84 and 86 with integral upwardly projecting resilient fingers for receiving the respective time demand switch 54, date demand switch 56, minute set switch 58, and hour set switch 60. Centrally located of the module frame is a large substantially V-shaped groove 90 having a flat bottom 92 and upwardly sloping sides 94 and 96. The central portion of upwardly sloping side 96 is recessed as at 98 to provide room for the large scale integrated circuit 34. This circuit is mounted on the back of ceramic substrate 32 and is received in the recess 98. The ends of substrate 32 are secured to the two ends of sidewall 96 on opposite sides of recess 98 by epoxy as illustrated at 100 in FIG. 5. Sloping side 96 is longer than side 94 and defines a portion of an upstanding boss or thickened section 102 of the module frame which contains a recess 104 receiving the quartz crystal inside quartz crystal can 40 which is secured in this recess again by a suitable insulating adhesive such as epoxy as indicated at 106 in FIG. 5. The quartz crystal 40 is connected to substrate 32 by a pair of leads, one of which is indicated at 108.

Ceramic substrate 32 is preferably of multilayer construction and contains printed circuitry as well as a plurality of leads 110 for electrical connection to the power supply and other electrical components of the wristwatch. Connection to the printed circuit, which is preferably formed intermediate two or more layers, and to the components on the back and front surfaces of the ceramic substrate, is made by connector pins or the like (not shown) passing through the substrate. For a more detailed description of this type of construction, reference may be had to assignee's copending applications Ser. No. 504,734, and Ser. No. 504,770, both filed Sept. 10, 1974. In addition to the electro-optical display, the front surface of the substrate carries other components such as a pair of bipolar driver transistor arrays, capacitors, a resistor and a photosensor 112. The photosensor controls the energization of the display in accordance with ambient light as more fully described below. The display 36 comprises four display stations for showing at least the hours and minutes of the time in decimal number form and includes a pair of colon dots 114 all of which diode elements are formed from light emitting diode segments.

Module frame 72 is secured to the bezel by a pair of screws (not shown) which pass through apertures 116 and 118 in the module frame and are threadedly received into the bezel. A pair of recesses 120 secure the ends of a pair of battery terminals as more fully described below and trimmer leads 122 connect to pins passing through the substrate to form electrical connection to the oscillator variable capacitor or trimmer 62.

Figure 7:
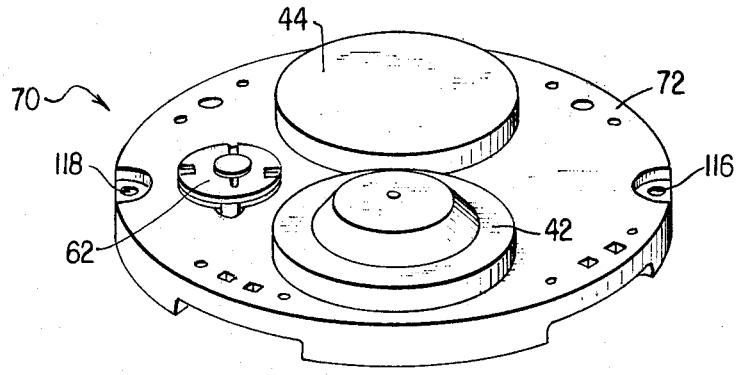
FIG. 7 is a perspective view of the rear side of the module assembly of FIG. 4.
Figure 8:
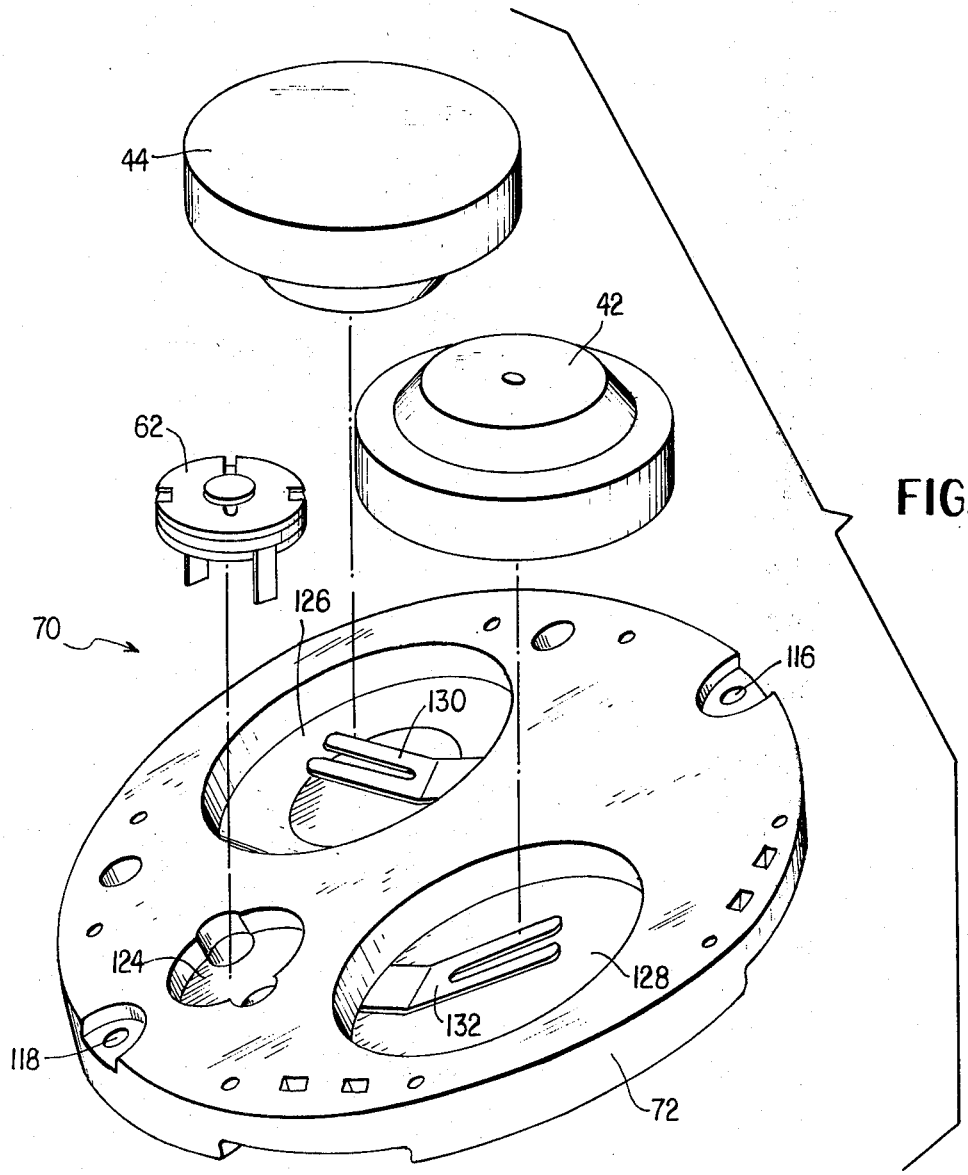
FIG. 8 is an exploded view of the structure shown in FIG. 7.

FIG. 7 is a perspective view of the rear side of module frame 72 and FIG. 8 is an exploded view of the rear side of the module frame and associated components. Trimmer 62 is received in a recess 124 and contains a pair of leads which connect to the trimmer pads of FIGS. 4 and 6. The battery cells 42 and 44 are received in battery wells 126 and 128 at the bottom of which lie the resilient spring battery terminals 130 and 132. Their ends pass through the frame into the recesses 120 where they are connected to the remainder of the circuitry by leads 121 and 123 (FIG. 6) extending from them to the substrate 32. The opposite sides of the battery are retained by a cell connector of the type illustrated at 48 in FIG. 1 which connects the batteries in series.

FIG. 9 shows the light control circuit used in conjunction with the photosensor 112 of FIGS. 4 and 6. In FIG. 9, the photosensor is shown as a photo-transistor but it is understood that a photo resistor in place of the transistor 112 may be used as desired. The control circuit comprises a pair of N channel MOS transistors 140 and 142 in addition to photosensor 112, a capacitor 144, a resistor 146 and a NAND gate 148. A display enable pulse 150 having a duration, for example, of 1 ¼ seconds, is applied to one input 152 labeled X when either the time demand switch 54 or the date demand switch 56 is actuated by one of the respective magnetic pushbuttons 16 or 18. This is applied to one input of NAND gate 148 enabling that gate. It is also applied to the gate electrode of MOS transistor 140. A series of narrow width pulses having a frequency of 512 Hz derived from the binary divider connected to the output of the crystal oscillator previously described is applied to a second input terminal 154 labeled Y. These divider-derived pulses are illustrated at 156. They are applied continuously to the gate electrode of MOS transistor 142. The lower side of transistor 142 and the lower side of capacitor 144 are connected to the negative side of the power supply battery cells indicated as ground whereas the upper side of photo transistor 112 and the upper end of resistor 146 are connected to the positive side of the power supply indicated as $+V_{DD}$.

In operation, when a display enable signal 150 is given, capacitor 144 is alternately charged through photo-transistor 112 and resistor 146 toward the positive voltage $V_{DD}$ and discharged by the 512 Hz signal 156 at input terminal 154. The width of the output pulses 160 indicated by the dimension A as appearing on output lead 162 in FIG. 9 is variable and is determined by the current flow through photo-transistor 112. This in turn is determined by the intensity of the ambient light incident on the photo-transistor. Thus, the output pulses 160 have a frequency of 512 Hz but they have a variable duty cycle as determined by the effective resistance of the photo-transistor which is proportional to the light incident on the display and on the photo-transistor 112 mounted on the front surface of the ceramic substrate 32 adjacent the display diodes 36.

It is apparent from the above that the present invention provides an improved wristwatch construction with an angularly oriented display and particularly an improved construction comprising a novel modular circular frame assembly so that the watch may be simply and inexpensively constructed and be made of relatively small size and thickness as compared to previous angularly oriented constructions. The angle of the orientation of the display is preferably approximately 45° with respect to a vertical plane passing through the center of the watch but the angular orientation may be varied as desired in accordance with the design of the watch case. The circular nature of the modular construction makes it fully compatible with a wide variety of case designs permitting more options and more flexibility in the design of attractive case variations.

The aperture 20 in FIG. 1 may be varied as desired but in general does not extend substantially beyond the central plane 164 of the watch case transverse to the wristband 14. It likewise preferably has a central longitudinal axis 166 which intersects the plane of backplate 24 at an angle of approximately 45° to coincide with the angular orientation of the display and supporting substrate. Since the display is recessed in this manner, it is partially shaded by the lip or hood 168 (FIG. 3) of the watch case. This shading by the hood formed by the watch case makes the watch more easy to read in direct sunlight since in almost all positions the display is shaded either by the hood, by the wearers body or both. By recessing the display and placing it back away from the filter 30, the contrast ratio of the display is increased at the same time that the amount of ambient light reflected back out through the filter is decreased.

The increase in contrast ratio and decrease in reflected light makes possible the more sensitive light control circuit of FIG. 9 since contrast and therefore apparent brightness are increased under normal viewing conditions. Since brightness in previous constructions is adequate under these same conditions, it is possible to reduce the current flow through the light emitting diodes and still have the same brightness as is presently available. Since most viewing is done under room ambient light conditions, the battery energy now saved is substantial. Furthermore, if desired, current through the light emitting diodes under direct sunlight viewing conditions can be increased to improve readability in the sunlight without unduly draining the watch battery.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency are therefore intended to be embraced therein.

We claim:

1. A wrist watch comprising a watch case having a flat back plate and bezel, said bezel having a viewing window with a central axis intersecting the plane of said back plate at an acute angle, a plurality of light emitting diode digital display elements and a photosensor within said case adjacent said window, means coupled to said photosensor for controlling the electrical energy supplied to said display elements in response to the amount of ambient light passing through said window and impinging on said photosensor, said display elements being mounted on an electrically insulating substrate, a large scale integrated circuit on said substrate and electrically coupled to said display element, said large scale integrated circuit being mounted on the opposite side of said substrate from said display elements, and a module frame inside said case supporting said substrate, said module frame having a substantially V-shaped groove with long and short sides, said substrate being supported by the long side of said groove.

2. A wristwatch according to claim 1 including an oscillator crystal and a plurality of switches mounted on said module frame.

3. A wristwatch according to claim 2 including a pair of wells in the side of said module frame opposite said substrate for removably receiving a pair of battery cells.

4. A wristwatch according to claim 3 wherein said switches comprise reed switches.

5. A wristwatch according to claim 1 wherein said substrate comprises a ceramic block having on one side said display elements and photosensor and on the other side said large scale integrated circuit, and a plurality of electrical leads extending outwardly for electrical connection to other components of said wristwatch.

6. A wrist watch comprising a watch case having a flat back plate and a bezel, said bezel having a viewing window with an central axis intersecting the plane of said back plate at an acute angle, a band pass optical filter in said window, a circular electrically insulating module frame in said case, said frame having thinner and thicker portions defining an outwardly extending wall at least substantially parallel with said filter, a plurality of light emitting diode digital display stations supported by said wall adjacent said filter, a photosensor in said case adjacent said window, and means coupled to said photosensor for controlling the electrical energy applied to said display elements in response to the amount of ambient light passing through said window and impinging on said photosensor.

7. A wristwatch according to claim 6 wherein said display stations are mounted on a ceramic substrate, a large scale integrated circuit on the side of said substrate opposite said display stations, said wall having a cut-away portion receiving said large scale integrated circuit.

8. A wristwatch according to claim 7 wherein said bezel is curved, said window lying at least substantially on one side of a transverse plane passing through its center.

9. A wristwatch according to claim 8 wherein said display stations give off red light, said filter passing only red light in the visible spectrum.

10. A wristwatch according to claim 8 wherein said thicker portions of said module frame includes a recess receiving an oscillator crystal, said cut-away portion of said wall having a notch for passing electrical leads from said recess to said substrate.

11. A wristwatch according to claim 6 wherein said means for controlling electrical energy comprises a variable duty cycle circuit.

12. A wristwatch according to claim 11 wherein said duty cycle circuit comprises a NAND gate having a first input for receiving a display enable signal and a second input for receiving a series of variable width pulses.

13. A wristwatch according to claim 12 wherein said photosensor is coupled to a capacitor, said photosensor acting as a variable charging resistor for said capacitor.

14. A wristwatch according to claim 13 including an MOS transistor coupled to said capacitor for periodically discharging it.

* * * * *